US008438770B2

(12) United States Patent
Troy

(10) Patent No.: US 8,438,770 B2
(45) Date of Patent: May 14, 2013

(54) FIREARM HANDGUARD SYSTEM

(76) Inventor: Stephen P. Troy, Lee, MA (US)

( * ) Notice: Subject to any disclaimer, the term of this patent is extended or adjusted under 35 U.S.C. 154(b) by 0 days.

(21) Appl. No.: 13/433,621

(22) Filed: Mar. 29, 2012

(65) Prior Publication Data

US 2012/0246989 A1 Oct. 4, 2012

Related U.S. Application Data

(60) Provisional application No. 61/469,444, filed on Mar. 30, 2011.

(51) Int. Cl.
*F41C 23/16* (2006.01)

(52) U.S. Cl.
USPC ..... 42/71.01

(58) Field of Classification Search ..... 42/71.01, 42/72, 73, 75.01, 75.02, 75.03
See application file for complete search history.

(56) References Cited

U.S. PATENT DOCUMENTS

| | | | | |
|---|---|---|---|---|
| 1,173,582 | A * | 2/1916 | Johnson | 42/75.02 |
| 3,208,178 | A * | 9/1965 | Seiderman | 42/71.01 |
| 3,367,054 | A * | 2/1968 | Loffler et al. | 42/71.01 |
| 6,779,288 | B1 * | 8/2004 | Kim | 42/72 |
| 7,770,317 | B1 * | 8/2010 | Tankersley | 42/71.01 |
| 2012/0186123 | A1 * | 7/2012 | Troy et al. | 42/71.01 |

* cited by examiner

*Primary Examiner* — Michael Carone
*Assistant Examiner* — Reginald Tillman, Jr.
(74) *Attorney, Agent, or Firm* — Parsons & Goltry; Robert A. Parsons; Michael W. Goltry

(57) ABSTRACT

A firearm includes a receiver with a socket defined by a forwardly extending circumferential rim having an inner surface, a barrel extending from the socket of the receiver and terminating in a muzzle, and a cocking lever housing carried above the barrel. A partial tubular body is received over the barrel with a rearward end abutting the receiver at the forwardly extending circumferential rim. A clamp element is carried by the partial tubular body and is movable between a release position and an engaged position in which a clamp end of the clamp element frictionally engages the inner surface of the circumferential rim.

11 Claims, 6 Drawing Sheets

FIREARM HANDGUARD SYSTEM

CROSS-REFERENCE TO RELATED APPLICATIONS

This application claims the benefit of U.S. Provisional Application No. 61/469,444 filed 30 Mar. 2011.

FIELD OF THE INVENTION

This invention relates to firearms.

More particularly, the present invention relates to handguards for use on firearms.

BACKGROUND OF THE INVENTION

In the field of firearms, handguards are ubiquitous and ever changing. Originally, handguards were used to provide something to grasp while firing the weapon. The handguard provided a comfortable grip and protected the user's hands from the heat of the barrel. Over the years, methods of attachment of handguards and additions to the handguard have been developed. However, many firearms are limited to the original handguard provided with the firearm. Often, these handguards are less than adequate or simply do not satisfy the firearm operator. These handguards can be difficult to remove and replace.

It would be highly advantageous, therefore, to remedy the foregoing and other deficiencies inherent in the prior art.

An object of the present invention is to provide a new and improved handguard for a firearm.

SUMMARY OF THE INVENTION

Briefly, to achieve the desired objects and advantages of the instant invention, provided is a handguard system for use on a firearm having a receiver with a socket defined by a forwardly extending circumferential rim, a barrel received within the socket of the receiver, and a cocking lever housing carried above the barrel. The handguard system includes a partial tubular body having a rearward end, a forward end, an inner surface, and an open slot formed along a top thereof to accommodate the cocking lever housing. The partial tubular body is receivable over the barrel of a firearm with the rearward end abutting the receiver at the forwardly extending circumferential rim. A circumferentially extending groove is formed in the inner surface of and forward from the rearward end of the partial tubular body. A clamp element, having a body with a clamp end and a heel extending substantially perpendicularly from an opposing end of the body, is adjustably positioned within the partial tubular body with the heel extending radially outwardly and received in the circumferential groove. The clamp element is movable between an engaged position and a release position.

In another aspect of the invention, the clamp element includes a threaded aperture formed through the body and a fastener inserted through the partial tubular body and received in the threaded aperture.

When the handguard system is mounted on the firearm, the clamp element is movable between a release position and an engaged position in which the clamp end of the clamp element frictionally engages the inner surface of the circumferential rim.

In yet another aspect wherein the firearm includes a holding clip with apertures extending from the cocking lever tube, an additional securing feature is a bracket having a curvature substantially matching a curvature of the inner surface of the partial tubular body. The bracket terminates at spaced apart first and second ends having apertures formed therethrough. Fastening members are receivable concurrently through apertures formed in the partial tubular body, the apertures formed through the first end and the second end of the bracket and the aperture formed through the holding clip.

BRIEF DESCRIPTION OF THE DRAWINGS

Specific objects and advantages of the invention will become readily apparent to those skilled in the art from the following detailed description of a preferred embodiment thereof, taken in conjunction with the drawings in which.

DETAILED DESCRIPTION OF A PREFERRED EMBODIMENT

Figure 1:
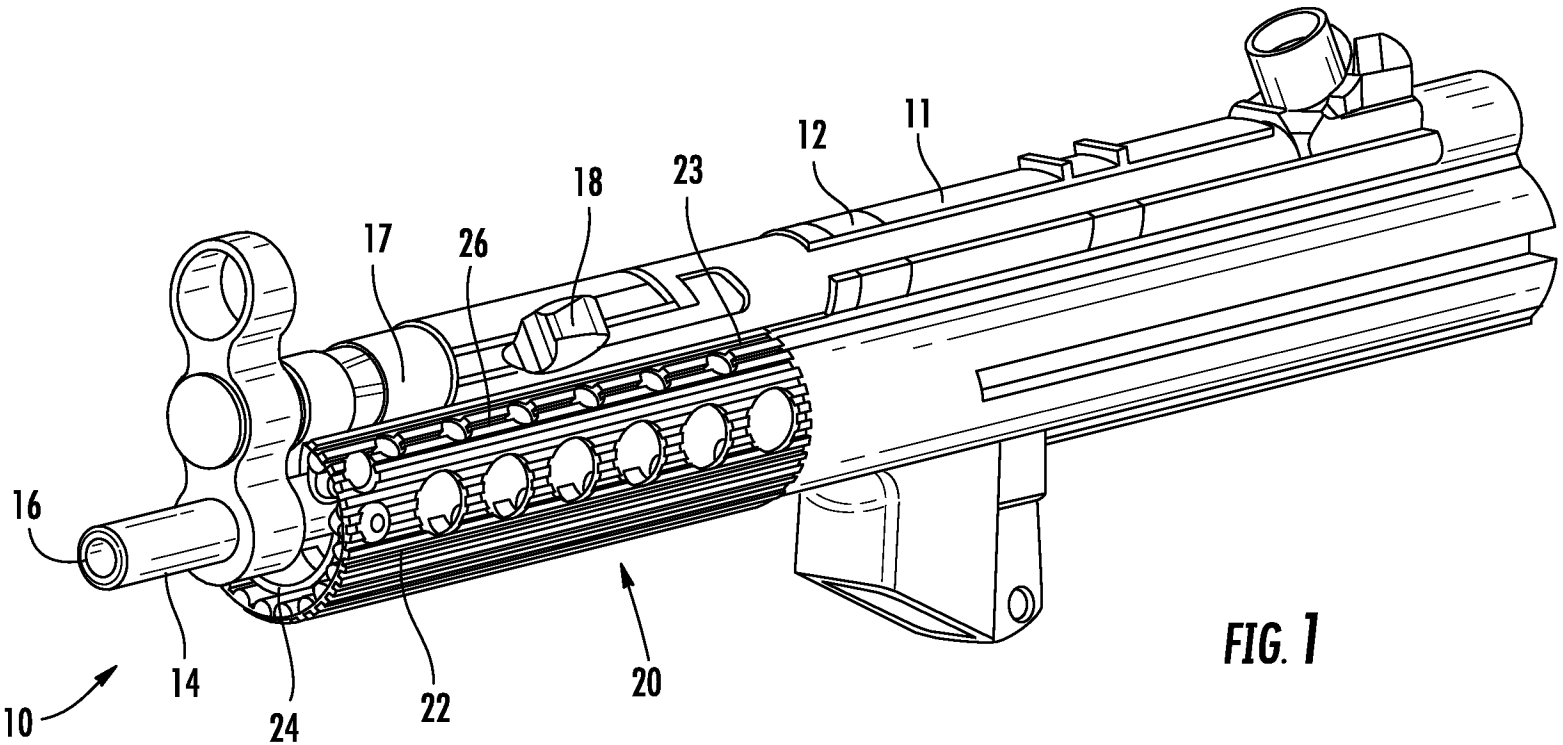
FIG. 1 is a perspective view of a handguard system according to the present invention carried by an MP5.
Figure 2:
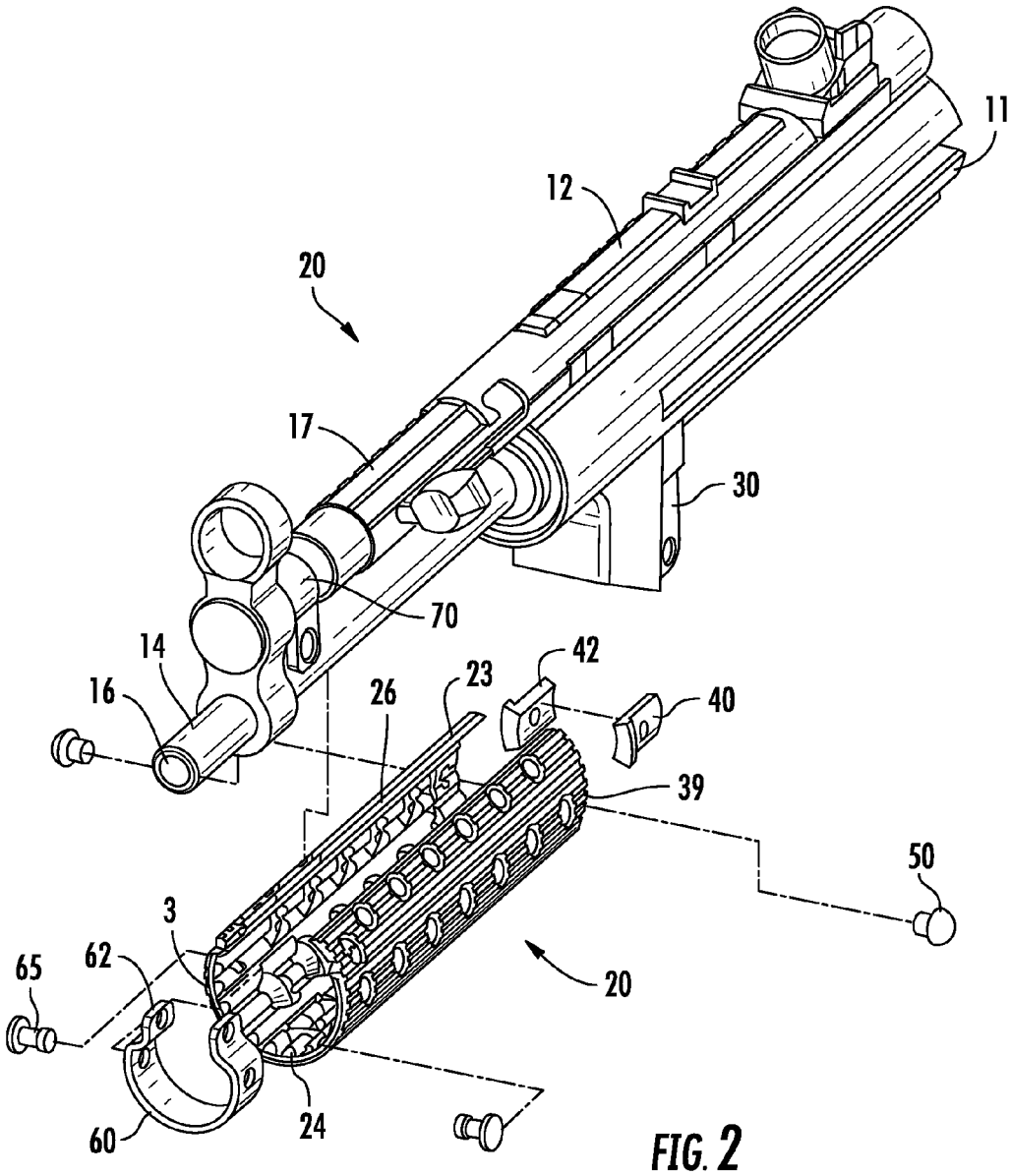
FIG. 2 is an exploded perspective view of the handguard system of FIG. 1.

Turning now to the drawings in which like reference characters indicate corresponding elements throughout the several views, attention is directed to FIGS. 1 and 2 which illustrate an MP5 firearm generally designated 10. Firearm 10 includes a receiver 11 having a rail 12 formed on an upper surface thereof, a barrel 14 extending from receiver 11 and terminating in a muzzle 16, a cocking lever housing 17 above barrel 14, a cocking lever 18 carried by the cocking lever housing, and a handguard system generally designated 20 coupled thereto. With additional reference to FIG. 4, handguard system 20 includes a partial tubular body 22 having a rearward end 23 and a forward end 24. An open slot 26 is formed along a top of partial tubular body 22 to accommodate cocking lever housing 17.

It will be understood that while the present invention is used in conjunction with a firearm of the type referred to as an MP5, the invention can be used with other MP5 type firearms such as G3 and G33.

Figure 3:
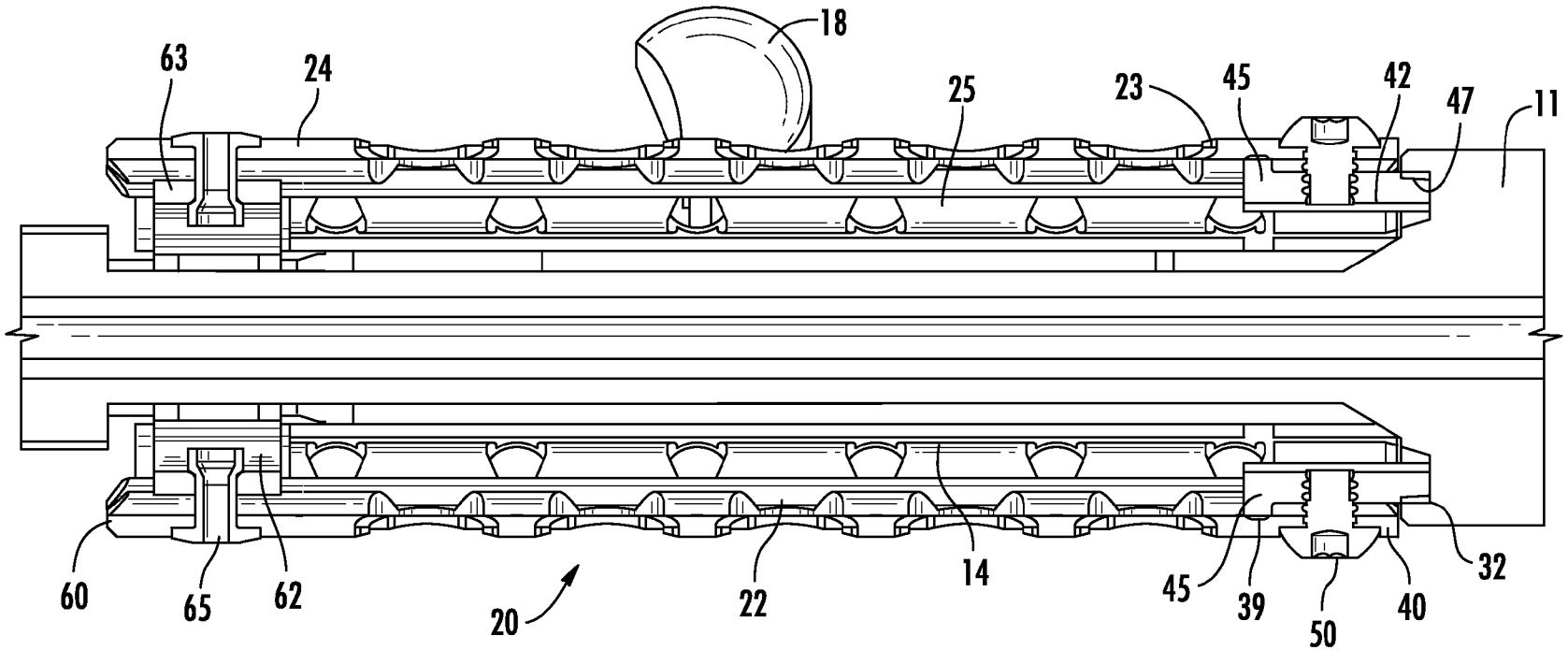
FIG. 3 is an enlarged cross section of the handguard system attached to a firearm.
Figure 5:
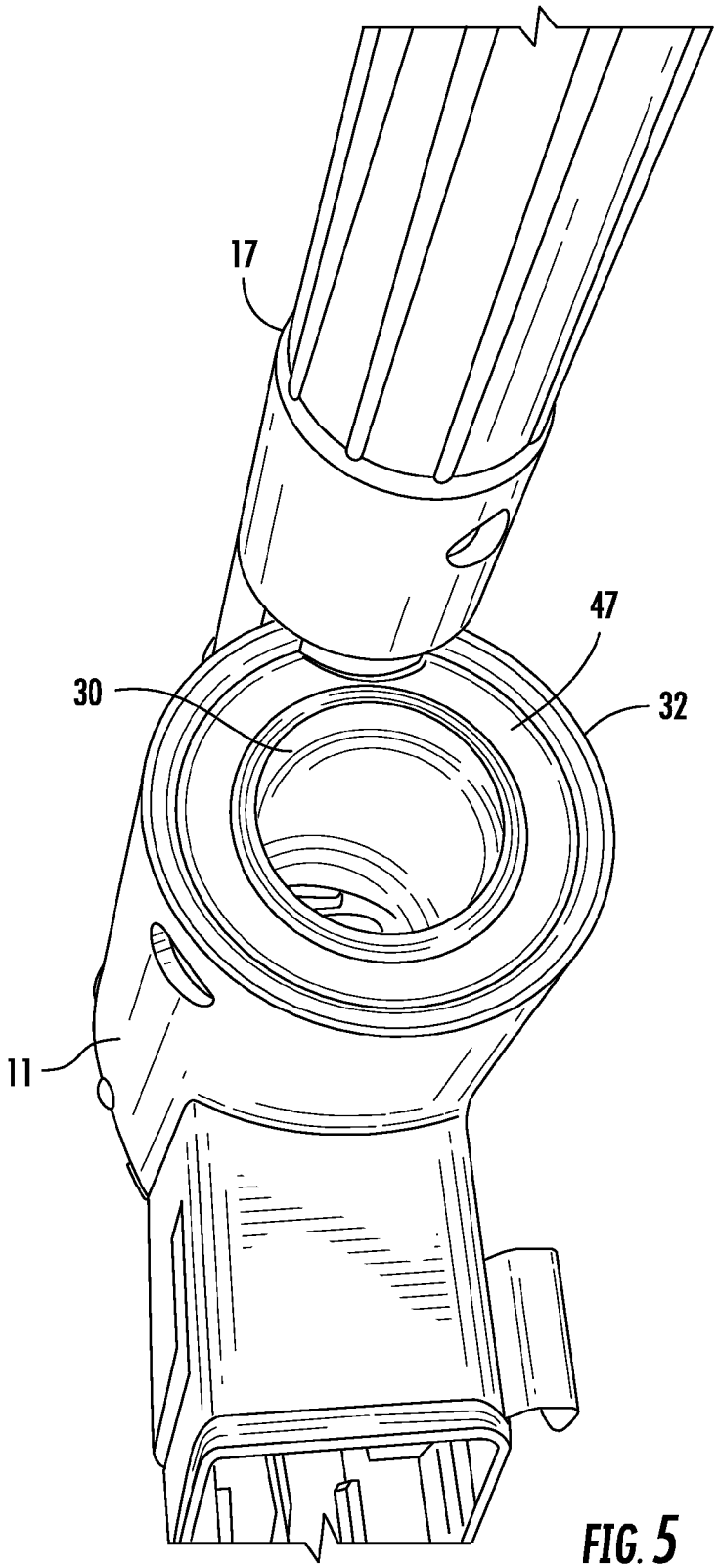
FIG. 5 is a perspective end view of a receiver of an MP5.
Figure 6:
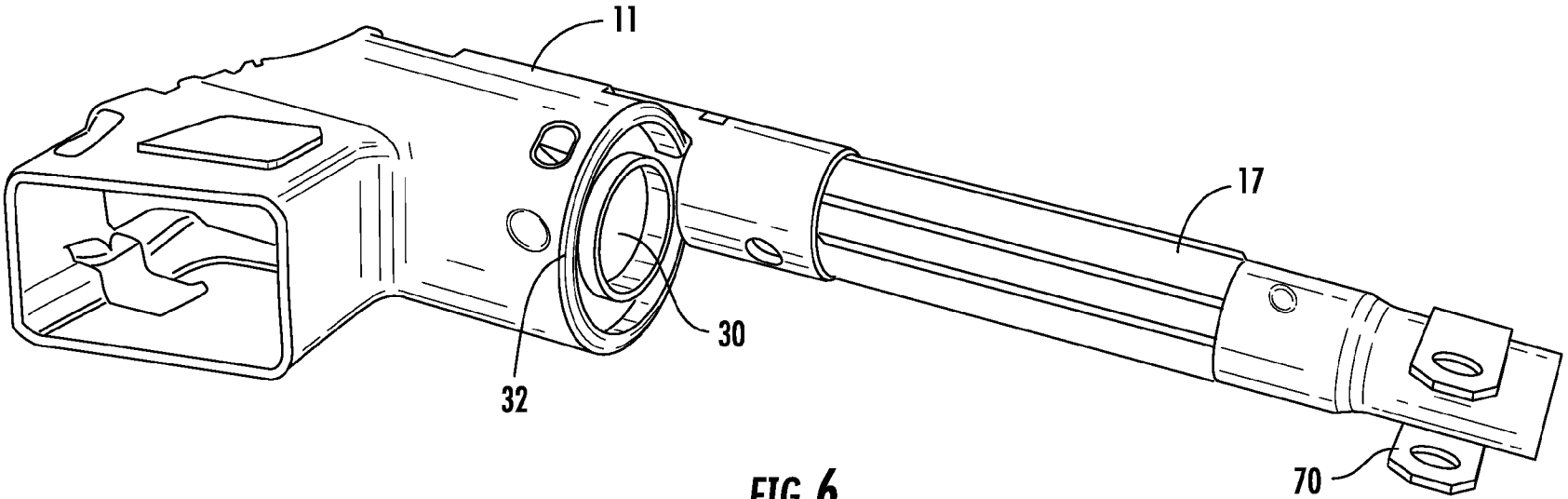
FIG. 6 is a side view of the receiver of FIG. 4.

Referring now to FIG. 3, a cross sectional view of handguard system 20 is illustrated. Barrel 14 is attached directly to receiver 11 by receipt within socket 30 defined by a forwardly extending circumferential rim 32, as can be seen with additional reference to FIGS. 5 and 6. Further detail of the receiver and barrel attachment of an MP5 type firearm will not be described further as they are well known in the art. Rearward end 23 of partial tubular body 22 is positioned over barrel 14 in a position abutting receiver 11 at forwardly extending circumferential rim 32. An inner surface 25 of partial tubular body 22 includes a circumferential groove 39 formed forward from rearward end 23.

Figure 4:
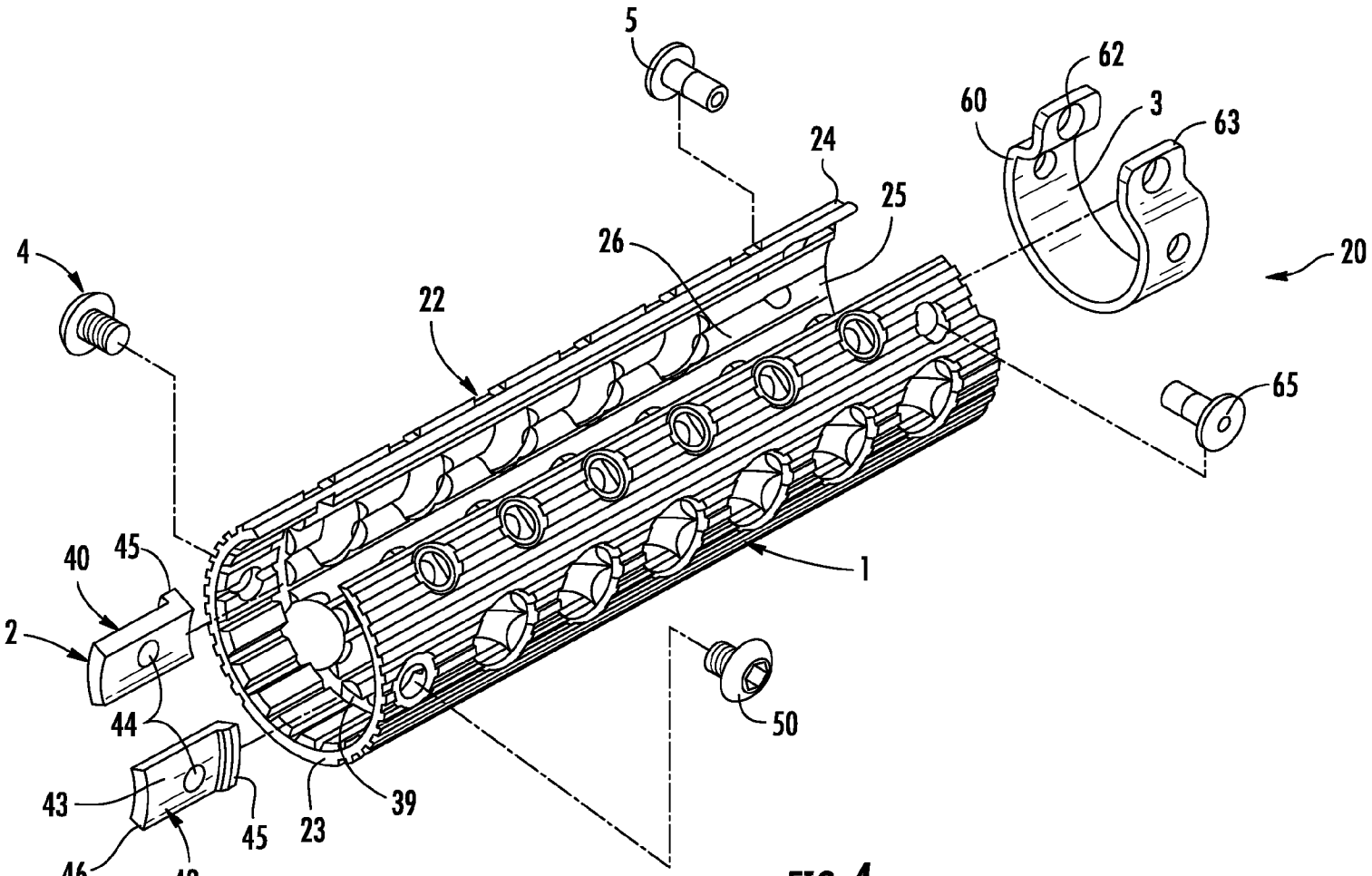
FIG. 4 is an exploded perspective view of the handguard system.

With additional reference to FIG. 4, partial tubular body 22 is restrained in position by a clamp assembly including clamp elements 40 and 42. More clamp elements can be employed as desired. Clamp elements 40 and 42 each include a body 43 having a threaded aperture 44 therethrough and a heel 45 extending substantially perpendicularly from an end of body 43 and a clamp end 46 opposite heel 45. Clamp elements 40 and 42 are positioned within partial tubular body 22 with the heels 44 extending radially outwardly and received in groove 39. A fastener, such as a screw 50, is inserted through partial tubular body 22 and received in threaded aperture 44. Clamp elements 40 and 42 are positioned prior to positioning partial tubular body 22 against receiver 11. With partial tubular body 22 properly positioned, clamp ends 46 of clamp elements 40 and 42 engage an inner surface 47 of forwardly extending circumferential rim 32. As can be seen in FIG. 3, clamp ends 46 of clamp elements 40 and 42 opposite heels 45 preferably extend slightly beyond rearward end 23 of partial tubular body 22. Clamp elements 40 and 42 are moveable between an engaged position and a release position. As screws 50 are tightened, clamp elements 40 and 42 are moved toward inner surface 25 of partial tubular body 22, with ends 46 opposite heels 45 being forced outwardly against inner surface 47 of forwardly extending circumferential rim 32 to form a friction engagement in the engaged position. With heels 45 secure within groove 39, partial tubular body 22 is securely held by the friction engagement.

Referring back to FIGS. 1 and 2, and with additional reference to FIG. 4, an additional securing element is employed at forward end 24 of partial tubular body 22. The additional securing element is a bracket 60 formed in a general C-shape. Bracket 60 has a curvature matching the inner curvature of partial tubular body 22, and terminates at spaced apart ends 62 and 63. Ends 62 and 63 receive fastening members such as screws/pins 65 through apertures therein. Pins 65 extend concurrently through apertures formed in partial tubular body 22, bracket 60 and a holding clip 70 (FIG. 6) extending from cocking lever housing 17.

Various changes and modifications to the embodiments herein chosen for purposes of illustration will readily occur to those skilled in the art. To the extent that such modifications and variations do not depart from the spirit of the invention, they are intended to be included within the scope thereof, which is assessed only by a fair interpretation of the following claims.

Having fully described the invention in such clear and concise terms as to enable those skilled in the art to understand and practice the same, the invention claimed is:

1. A handguard system for use on a firearm having a receiver with a socket defined by a forwardly extending circumferential rim, a barrel received within the socket of the receiver, and a cocking lever housing carried above the barrel, the handguard system comprising:

a partial tubular body having a rearward end, a forward end, an inner surface, and an open slot formed along a top thereof to accommodate the cocking lever housing, the partial tubular body receivable over the barrel of a firearm with the rearward end abuttable against the receiver at the forwardly extending circumferential rim;

a circumferentially extending groove formed in the inner surface of and forward from the rearward end of the partial tubular body; and a clamp element having a body with a clamp end and a heel extending substantially perpendicularly from an opposing end of the body, adjustably positioned within the partial tubular body with the heel extending radially outwardly and received in the circumferential groove, wherein the clamp element is movable between an engaged position and a release position.

2. A handguard system as claimed in claim 1 wherein the clamp element further includes a threaded aperture formed through the body and a fastener inserted through the partial tubular body and received in the threaded aperture.

3. A handguard system as claimed in claim 1 further including a second clamp element having a body with a clamp end and a heel extending substantially perpendicularly from an opposing end of the body, the second clamp element adjustably positioned within the tubular body with the heel extending radially outwardly and received in the circumferential groove.

4. A handguard system as claimed in claim 1 for use on a firearm further including a holding clip with apertures, extending from the cocking lever housing, the handguard system further comprising:

a bracket having a curvature substantially matching a curvature of the inner surface of the partial tubular body, the bracket terminates at spaced apart first and second ends;

apertures formed through the first end and the second end; and fastening members receivable concurrently through apertures formed in the partial tubular body, the apertures formed through the first end and the second end of the bracket and the aperture formed through the holding clip.

5. A firearm comprising:

a receiver with a socket defined by a forwardly extending circumferential rim having an inner surface;

a barrel extending from the socket of the receiver and terminating in a muzzle;

a cocking lever housing carried above the barrel;

a partial tubular body having a rearward end, a forward end, an inner surface, and an open slot formed along a top thereof to accommodate the cocking lever housing, the tubular body received over the barrel with the rearward end abutting the receiver at the forwardly extending circumferential rim and the cocking lever housing extending through the open slot;

a circumferentially extending groove formed in the inner surface of and forward from the rearward end of the partial tubular body; and a clamp element having a body with a clamp end and a heel extending substantially perpendicularly from an opposing end of the body, adjustably positioned within the partial tubular body with the heel extending radially outwardly and received in the circumferential groove;

wherein the clamp element is movable between a release position and an engaged position in which the clamp end of the clamp element frictionally engages the inner surface of the circumferential rim.

6. A firearm as claimed in claim 5 wherein the clamp element further includes a threaded aperture formed through the body and a fastener inserted through the tubular body and received in the threaded aperture, the fastener moving the clamp element between the release position and the engaged position.

7. A firearm as claimed in claim 5 further including a second clamp element having a body with a clamp end and a heel extending substantially perpendicularly from an opposing end of the body, adjustably positioned within the partial tubular body with the heel extending radially outwardly and received in the circumferential groove.

8. A firearm as claimed in claim 5 wherein the firearm further comprises:

a holding clip an aperture, the holding clip extending from the cocking lever housing;

a bracket having a curvature substantially matching a curvature of the inner surface of the partial tubular body, the bracket terminating at spaced apart first and second ends;

apertures formed through the first end and the second end; and fastening members receivable concurrently through apertures formed in the partial tubular body, the apertures formed through the first end and the second end of the bracket and the aperture formed through the holding clip.

9. A handguard system for use on a firearm having a receiver with a socket defined by a forwardly extending circumferential rim, and a barrel received within the socket of the receiver, the handguard system comprising:

a partial tubular body having a rearward end, a forward end and an inner surface, the partial tubular body receivable over the barrel of a firearm with the rearward end abuttable against the receiver at the forwardly extending circumferential rim;

a circumferentially extending groove formed in the inner surface of and forward from the rearward end of the partial tubular body; and a clamp element having a body with a clamp end and a heel extending substantially perpendicularly from an opposing end of the body, adjustably positioned within the partial tubular body with the heel extending radially outwardly and received in the circumferential groove, wherein the clamp element is movable between an engaged position and a release position.

10. A handguard system as claimed in claim 9 wherein the clamp element further includes a threaded aperture formed through the body and a fastener inserted through the partial tubular body and received in the threaded aperture.

11. A handguard system as claimed in claim 9 further including a second clamp element having a body with a clamp end and a heel extending substantially perpendicularly from an opposing end of the body, the second clamp element adjustably positioned within the tubular body with the heel extending radially outwardly and received in the circumferential groove.

* * * * *